US005823648A

United States Patent [19]

Domenig

[11] Patent Number: 5,823,648

[45] Date of Patent: Oct. 20, 1998

[54] BRACKET FOR MOUNTING A DRAWER GUIDE

[75] Inventor: Georg Domenig, Kernersville, N.C.

[73] Assignee: Grass America, Inc., Kernersville, N.C.

[21] Appl. No.: 827,688

[22] Filed: Apr. 10, 1997

[51] Int. Cl.[6] ..... A47B 88/00

[52] U.S. Cl. ..... 312/334.5; 312/334.7

[58] Field of Search ..... 312/334.5, 334.4, 312/334.7, 334.1, 334.27, 330.1, 350; 384/22; 248/220.21, 220.31, 220.41, 220.42, 220.43, 231.9, 225.11

[56] References Cited

U.S. PATENT DOCUMENTS 4,244,546 1/1981 Mertes et al. ..... 312/334.4 X
5,039,181 8/1991 Lautenschlager ..... 312/334.7
5,257,861 11/1993 Domenig et al. ..... 248/223.41 X
5,387,033 2/1995 Domenig ..... 312/334.5
5,428,866 7/1995 Aschow ..... 248/223.41 X
5,636,820 6/1997 Domenig ..... 312/334.5 X

*Primary Examiner*—Jose V. Chen
*Assistant Examiner*—Janet M. Wilkens
*Attorney, Agent, or Firm*—John M. Harrington; Kilpatrick Stockton LLP

[57] ABSTRACT

A bracket for mounting a drawer guide in a furniture article includes a plate member and one or more spring flanges disposed on the top surface of the plate member near the front end of the plate member to engage the drawer guide. One or more fasteners extends from the bottom surface of the plate member for attaching the bracket to the furniture article. A stop member extends from the top surface of the plate member and is disposed between the spring flanges to be received in an opening formed in a tongue portion of the drawer guide.

5 Claims, 1 Drawing Sheet

BRACKET FOR MOUNTING A DRAWER GUIDE

BACKGROUND OF THE INVENTION

1. Field of the Invention

The present invention relates to a bracket for mounting a drawer guide in a furniture article such as a desk or cabinet and more particularly to a new and improved mounting bracket for a drawer guide of a type having a tongue portion, the bracket having a plate member with opposing spring flanges extending from the plate member to engage the drawer guide tongue portion and a stop member adapted to engage a slotted opening formed in the drawer guide tongue portion permitting limited lateral adjustment of the drawer guide.

2. Description of the Prior Art

Various types of mounting brackets for supporting a drawer guide in a furniture article such as a desk or cabinet have been used in the furniture and cabinetry industry for many years. For the most part, these brackets are inexpensively made and hence not precisely designed or machined to ensure stability, long wear and efficient operation. One such device is known from U.S. Pat. No. 5,257,861. Many of such devices have adjustment elements formed directly in the bracket body making it difficult to adjust, quick to wear, and soon unstable. To provide longer lasting mounting brackets that are operable with greater efficiency and more precise adjustability, it has been determined that more refined design and engineering skills are required. The present invention addresses this need and interest.

SUMMARY OF THE INVENTION

The general purpose of the present invention, which will be described subsequently in greater detail, is to provide a new and improved adjustable mounting bracket to be used on a desk or cabinet drawer having a drawer guide with a tongue portion that has all of the advantages of prior art brackets and none of the disadvantages. In order to attain this purpose, a representative embodiment of the present invention is illustrated in the drawings. The bracket of the present invention makes use of a plate member having a top surface and a bottom surface, opposing lateral edges, and front and rear ends. The bracket also includes support means disposed on the top surface of the plate member which is adapted to support a drawer guide, means for attaching the plate member to a furniture article, for example, a desk or cabinet wall, and stop means disposed on the top surface of the plate member which is adapted to engage an opening formed in the drawer guide. The stop means includes a stop member which extends from the top surface of the plate member and which is disposed between the front and rear ends of the plate member. The stop member is spaced closer to the front end of the plate member than to the rear end of the plate member. Preferably, the stop member is also substantially centered on the top surface of the plate member between the opposing lateral edges of the plate member. The stop member extends a predetermined distance above the top surface of the plate member which defines a height of the stop member.

The support means includes spring flange means disposed on the top surface of the plate member at or near the front end of the plate member and which is adapted to engage a drawer guide. The support means consists of at least one spring flange, and preferably a pair of opposing spring flanges. The support means also includes a pair of opposing walls, each of which extends from the top surface of the plate member at or near one of the opposing lateral edges of the plate member near the front end of the plate member. Each of the opposing walls supports one of the opposing spring flanges, and each of the opposing spring flanges includes a distal end portion. The respective distal end portions of the spring flanges extend toward one another, and each distal end portion is spaced from the top surface of the plate member to form a gap having a predetermined width which is adapted to receive the drawer guide. The width of the gap formed between the distal end portions of the spring flanges and the top surface of the plate member is at least as great as, and preferably greater than the height of the stop member. The distal end portions of the opposing spring flanges are spaced apart from one another, and the stop member is substantially centered between the distal end portions on the top surface of the plate member.

The gap formed between the distal end portions of the spring flanges and the top surface of the plate member is configured to receive the tongue portion of the drawer guide. The drawer guide tongue portion has an opening in the form of a slotted hole which is configured to receive the stop member when the drawer guide tongue portion is received in the gap. In order to enable the leading edge of the drawer guide tongue portion to pass over the stop member as the tongue portion is inserted into the gap, the stop member is provided with a ramp surface which slants upward away from the rear end of the plate member and over which the tongue portion can slide until the slotted hole reaches and receives the stop member.

The means for attaching the plate member to the furniture article includes at least one fastener, and preferably a pair of such fasteners. Each fastener extends from the bottom surface of the plate member and each has a dowel portion, and at least one hook member, and preferably a pair of hook members, extending from the dowel portion and adapted to engage the furniture article.

The opposing spring flanges which extend from the opposing walls are configured to cooperatively receive the drawer guide tongue portion under the opposing spring flanges. The ramp surface of the stop member is configured to permit the passage of the leading edge of the tongue portion over the stop member as the tongue portion is moved into engagement under the spring flanges. The height of the stop member is equal to or less that the gap width between the distal end portions of the spring flanges and the top surface of the plate member to facilitate the introduction of the drawer guide tongue portion into the gap under the spring flanges.

The stop member is designed to be received in the slotted hole of the tongue portion after the leading edge of the tongue portion clears the stop member. The spring flanges are designed to hold the tongue portion in position against lateral movement without exertion of a predetermined amount of lateral force on the drawer guide when the stop member is engaged in the slotted hole. When so engaged, such lateral movement is limited to the extent of the length of the slotted hole. In other words, lateral adjustment by exertion of such force is permitted within the limit of corresponding movement of the stop member within the slotted hole. Further, when so engaged, withdrawal of the tongue portion is prevented, for example, during shipment of an assembled drawer guide and bracket or during lateral adjustment of an installed device.

The bracket is designed primarily for use with a double captive drawer guide system which includes a drawer guide having a top flange which curves around the top of a roller of a drawer side rail and a drawer side rail having a top flange which curves around the top of a roller of the drawer guide. The drawer side rail roller cannot be disengaged from the guide rail and the guide rail roller cannot be disengaged from the drawer side rail by lateral force applied to the drawer. Thus, a lateral force applied to the installed drawer laterally repositions both drawer guides at the same time. Generally, a lateral force of from 6 to 8 pounds is required to laterally reposition a single mounted drawer guide. When a pair of opposing drawer guides are installed carrying a drawer weighing approximately 75 pounds (based on 15 lbs. weight per square foot of drawer bottom space) a total lateral force of 12 to 16 pounds is required to laterally reposition the entire assembly.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved bracket for mounting a drawer guide in a furniture article such as a desk or cabinet which has all the advantages, and more, of prior art devices and none of the disadvantages.

It is another object of the present invention to provide a new and improved mounting bracket for supporting a drawer guide that is more reliable and functional than those presently available.

Yet another object of the present invention is to provide a new and sophisticated, precision made mounting bracket that can operate reliably and efficiently and yet enable renewed preselected limited lateral adjustments to be made to the mounted drawer with respect to the furniture article.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

This invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
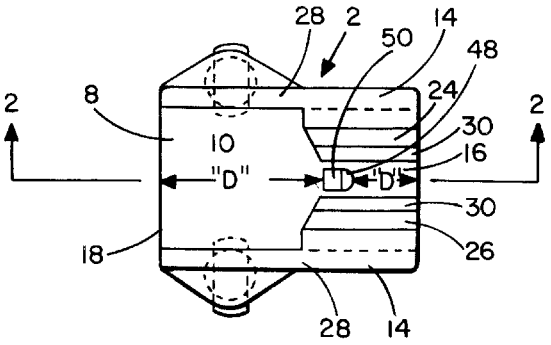
FIG. 1 is a top plan view of the bracket comprising the present invention.
Figure 3:
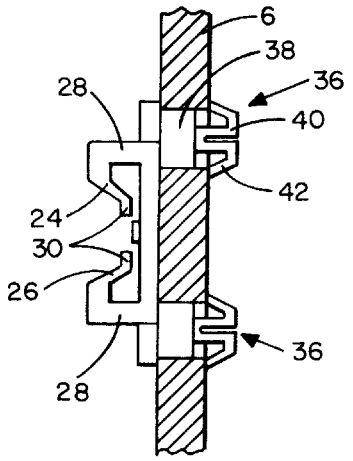
FIG. 3 is a front elevational view of the bracket shown in FIGS. 1 and 2.
Figure 4:
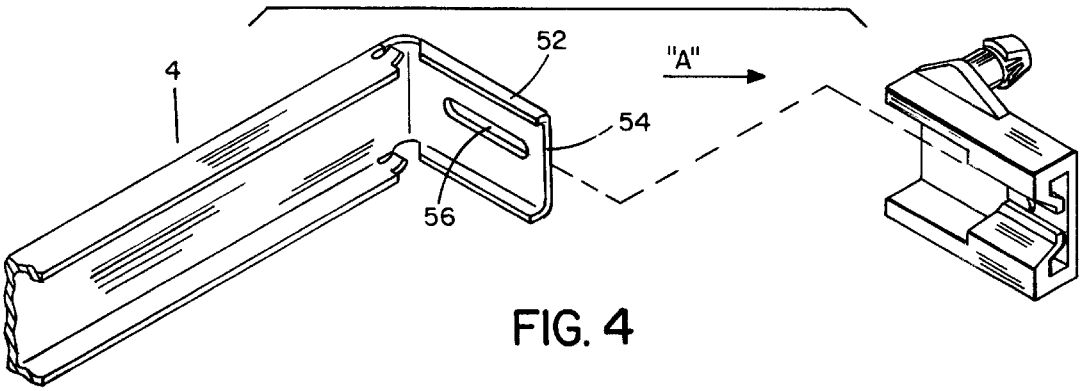
FIG. 4 is a perspective and fragmentary view of the drawer guide tongue portion that is cooperatively received by the bracket shown in FIGS. 1–3.

Referring now to the drawings, and specifically to FIG. 1, a bracket shown generally as 2 includes a plate member 8 having a top surface 10 and a bottom surface 12, opposing lateral edges 14, and front and rear ends 16, 18. Bracket 2 also includes support means disposed on top surface 10 of plate member 8 which is adapted to support a drawer guide 4 as shown in FIG. 4, means for attaching plate member 8 to a furniture article 6 as shown in FIG. 3, and stop means disposed on top surface 10 which is adapted to engage an opening 56 formed in drawer guide 4.

Figure 2:
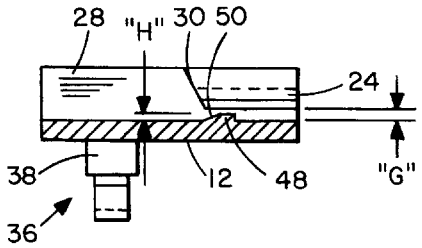
FIG. 2 is a side sectional view of the bracket as shown by line 2—2 in FIG. 1.
Figure 6:
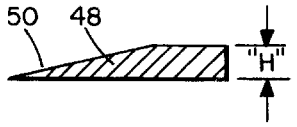
FIG. 6 is an enlarged view of the stop member of the bracket shown in FIGS. 1–5.

The stop means includes a stop member 48 extending from top surface 10 of plate member 8 which is disposed between front and rear ends 16, 18 and which is spaced a smaller distance "D" from front end 16 than the distance "D'" by which it is spaced from rear end 18. Preferably, stop member 48 is also substantially centered on top surface 10 between opposing lateral edges 14 of plate member 8. As shown in FIGS. 2 and 6, stop member 48 extends a distance "H" above top surface 10 of plate member 8, which defines a height of stop member 48.

The support means includes spring flange means disposed on top surface 10 proximate front end 16 of plate member 8 which is adapted to engage drawer guide 4 and consists of at least one spring flange 24, and preferably consists of a pair of opposing spring flanges 24, 26. The support means also includes a pair of opposing walls 28, each wall 28 extending from top surface 10 at or near one of the opposing lateral edges 14 proximate the front end 16 of plate member 8, and each wall 28 supporting one of the opposing spring flanges 24, 26. Each of the opposing spring flanges 24, 26 has a distal end portion 30.

The respective distal end portions 30 of spring flanges 24, 26 extend toward one another, and each distal end portion 30 is spaced from top surface 10 of plate member 8 to form a gap having a width "G" as shown in FIG. 2, which gap is adapted to receive drawer guide 4. The width "G" of the gap formed between distal end portions 30 and top surface 10 is at least as great as, and preferably greater than, the height "H" of stop member 48. The distal end portions 30 of opposing spring flanges 24, 26 are spaced apart from one another, and stop member 48 is substantially centered between distal end portions 30 on top surface 10 of plate member 8.

The gap formed between distal end portions 30 of spring flanges 24, 26 and top surface 10 of plate member 8 is configured to receive the tongue portion 52 of drawer guide 4 in arrow direction "A" as shown in FIG. 4. Tongue portion 52 has an opening in the form of a slotted hole 56 which is configured to receive stop member 48 when drawer guide tongue portion 52 is received in the gap. In order to enable the leading edge 54 of drawer guide tongue portion 52 to pass over stop member 48 as tongue portion 52 is inserted into the gap, stop member 48 is provided with a ramp surface 50 which slants upward away from rear end 18 of plate member 8 and over which tongue portion 52 can slide until slotted hole 56 reaches and receives stop member 48.

The means for attaching plate member 8 to furniture article 6, as shown in FIG. 3, includes at least one fastener shown generally as 36, and preferably a pair of such fasteners 36. Each fastener 36 extends from the bottom surface 12 of plate member 8, and each has a dowel portion 38, at least one hook member 40, and preferably a pair of hook members 40, 42, extending from dowel portion 38 and adapted to engage the furniture article 6.

Figure 5:
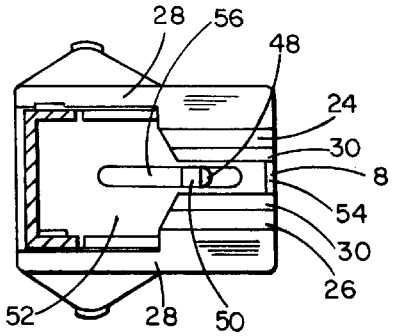
FIG. 5 is a sectional view of the drawer guide tongue portion received by the bracket shown in FIGS. 1–4.

Opposing spring flanges 24, 26 extending from opposing walls 28 are configured to cooperatively receive drawer guide tongue portion 52 as shown in FIG. 5. Tongue portion 52 is moved in arrow direction "A" as shown in FIG. 4 into engagement under opposing spring flanges 24, 26. Ramp surface 50 of stop member 48 is configured to permit the passage of leading edge 54 of tongue portion 52 over stop member 48 as tongue portion 52 is moved in arrow direction "A". Likewise, the height "H" of stop member 48 is equal to or less than gap width "G" between distal end portions 30 of spring flanges 24, 26 and top surface 10 of plate member 8 to facilitate the introduction of drawer guide tongue portion 52 under spring flanges 24, 26 and into gap "G".

Stop member 48 is designed to be received in slotted hole 52 of tongue portion 52 as tongue portion 52 is moved in arrow direction "A" after leading edge 54 clears stop member 48. Spring flanges 24, 26 are designed to hold tongue portion 52 in position against lateral movement without exertion of a predetermined amount of lateral force on drawer guide 4 when stop member 48 is engaged in slotted hole 54. When so engaged, such lateral movement is limited to the extent of the length of slotted hole 56. In other words, lateral adjustment by exertion of such force is permitted within the limit of corresponding movement of stop member 48 within slotted hole 54. Further, when so engaged, withdrawal of tongue portion 52 is prevented, for example, during shipment of an assembled drawer guide and bracket or during lateral adjustment of an installed device.

Obviously, any number of materials may be used to form the bracket and its components described herein, and exceptional success has been experienced by the use of semi-rigid plastic material, although other materials may be used when greater or lesser support is necessary.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A bracket for mounting a drawer guide in a furniture article, the bracket comprising:

a plate member having top and bottom surfaces, opposing lateral edges, and front and rear ends;

support means disposed on the top surface and being adapted to support said drawer guide;

means for attaching the plate member to said furniture article;

stop means disposed on the top surface and being adapted to engage an opening formed in said drawer guide;

said stop means comprising a stop member extending from said top surface of the plate member;

said stop member being disposed between said front and rear ends of the plate member and being spaced a smaller distance from the front end than from the rear end;

said support means comprising spring flange means disposed on said top surface proximate said front end of the plate member and adapted to engage said drawer guide;

said stop member being substantially centered on said top surface between said opposing lateral edges of the plate member;

said spring flange means comprising a pair of spring flanges opposing one another;

said support means further comprising a pair of opposing walls, each extending from said top surface proximate said front end of the plate member and supporting one of said opposing spring flanges;

each of said opposing spring flanges having a distal end portion, the distal end portions extending toward one another and being spaced from the top surface of the plate member to form a gap adapted to receive said drawer guide;

said stop member extending a distance above said top surface of the plate member a distance that defines a height of the stop member;

said gap being greater than said height of the stop member;

said distal end portions of the opposing spring flanges being spaced from one another, and said stop member being substantially centered between said distal end portions on said top surface of the plate member; and said stop member having a ramp surface slanting upward away from said rear end of the plate member.

2. The bracket as claimed in claim 1, said means for attaching the plate member to said furniture article comprising at least one fastener extending from said bottom surface of the plate member, the fastener having a dowel portion and at least one hook member extending from the dowel portion and adapted to engage the furniture article.

3. The bracket as claimed in claim 2, said means for attaching the plate member to said furniture article further comprising a pair of said fasteners.

4. The bracket as claimed in claim 3, each of said fasteners including a second hook member extending from said dowel portion and adapted to engage said furniture article.

5. A bracket for mounting a drawer guide in a furniture article, comprising:

a plate member having top and bottom surfaces, opposing lateral edges, and front and rear ends;

a pair of opposing spring flanges disposed on the top surface proximate the front end of the plate member, each of the opposing spring flanges having a distal end portion, the distal end portions extending toward one another and being spaced apart from one another and also being spaced from the top surface of the plate member to form a gap adapted to receive said drawer guide, a stop member extending from the top surface between said front and rear ends of the plate member and being substantially centered between the opposing lateral edges of the plate member and substantially centered between the distal end portions of the spring flanges and being adapted to engage said drawer guide, and said stop member having a ramp surface slanting upward away from said rear end of the plate member; and means for attaching the plate member to said furniture article.

* * * * *